United States Patent [19]

Horvay et al.

[11] Patent Number: 4,543,799

[45] Date of Patent: Oct. 1, 1985

[54] HOUSEHOLD REFRIGERATOR WITH AIR CIRCULATING AND COOLING ARRANGEMENT

[75] Inventors: Julius B. Horvay; Robert B. Gelbard, both of Louisville, Ky.

[73] Assignee: General Electric Company, Louisville, Ky.

[21] Appl. No.: 643,686

[22] Filed: Aug. 23, 1984

[51] Int. Cl.[4] ..... F25B 5/00

[52] U.S. Cl. ..... 62/283; 62/441

[58] Field of Search ..... 62/276, 283, 441

[56] References Cited

U.S. PATENT DOCUMENTS

| | | | |
|---|---|---|---|
| 3,766,976 | 10/1973 | Gelbard et al. | 165/122 |
| 4,077,229 | 3/1978 | Gelbard et al. | 62/283 |
| 4,211,090 | 7/1980 | Gelbard et al. | 62/238 |

*Primary Examiner*—Lloyd L. King

*Attorney, Agent, or Firm*—Frank F. Giacalone; Radford M. Reams

[57] ABSTRACT

A compact evaporator unit for a household refrigerator including a partition dividing the refrigerator into two separate compartments. The partition is formed with an evaporator compartment in which the evaporator is positioned. The evaporator comprises a tubular member having an extended heat exchange surface in the form of a pair of longitudinally extending helically coiled portions. The coiled portions are arranged parallel with the rear coil being elevated relative to the front coil. The rear coil is extended to form end coils which provide a central area between the end coils to accommodate a fan employed for moving air through the evaporator compartment. The rear coil being raised so that the flow of air passing through the evaporator compartment will impact on both coils to thereby increase the frost tolerance of the evaporator.

2 Claims, 3 Drawing Figures

HOUSEHOLD REFRIGERATOR WITH AIR CIRCULATING AND COOLING ARRANGEMENT

BACKGROUND OF THE INVENTION

The present invention relates to an evaporator assembly of the type disclosed in U.S. Pat. No. 3,766,976-Gelbard et al and 4,211,090-Gelbard et al, both assigned to General Electric Company, the assignee of the present invention.

The evaporator assembly in this type of refrigerator is in fact included in the partition which divides the fresh food compartment from the freezer compartment. Since the partition incorporating the evaporator is located totally within the refrigerator cabinet, it is essential that the amount of space it occupies be kept to a minimum. The temperature of the compartments is maintained by circulating air from the compartment across the evaporator coils. Due to the limited amount of space air flow initially contacts the leading portion of the evaporator and then flows downstream therethrough. When this happens frost builds up on the leading edge of the evaporator and accordingly restricts flow through the rest of the evaporator.

By the present invention the evaporator is so constructed that substantially all of the air flowing through the partition comes in direct contact with substantially all of the evaporator surface area. This requires that the evaporator assembly be designed and the parts arranged so that maximum air flow and efficiencies are built into an assembly occupying a minimum amount of space in the refrigerator cabinet.

In accordance with the present invention, a construction is provided which ensures an even distribution of frost throughout the evaporator surfaces, and which accomplishes this result in a simpler and more effective manner and with advantages not present in the prior art type arrangements described above.

Accordingly, it is an object of this invention to provide in a refrigerator of this type an improved air circulation and frost deposition arrangement which materially reduces interference with the circulation of air.

SUMMARY OF THE INVENTION

By the present invention there is provided a refrigerator cabinet including a fresh food storage compartment to be maintained at a temperature above freezing and a freezer compartment to be maintained at a temperature below freezing. An evaporator partition divides the cabinet into the compartments. The partition includes a lower wall portion defining the upper wall of the fresh food compartment, and a removable upper wall portion defining the lower wall of the freezer compartment. The partition includes an evaporator chamber defined between the lower and upper wall portions. Mounted in the evaporator chamber is an evaporator including a tubular member bent to form at least two interconnected longitudinally arranged helically coiled portions. The longitudinal axis of the rear coil being above the longitudinal axis of the forward coil. The rear coils are formed to provide a centrally located area between coiled end portions. Also formed in the partition are air passageways for directing a stream of air to be cooled through the evaporator chamber. The air passageways include inlets in the upper and lower wall portions for drawing air from the fresh food and freezer compartments and circulating through the evaporator chamber. An outlet in the upper wall portion directs air into passageway communicating with the freezer fresh food compartments. Located in the outlet opening is a fan whose drive motor is arranged in the centrally located area between the coiled end portions of the rear coil. The fan circulates air from the inlets to the passageways and through the evaporator to the outlet.

DESCRIPTION OF THE PREFERRED EMBODIMENT

While the present invention is applicable to any refrigerator including one or more storage compartments and an evaporator for cooling the compartment disposed in an evaporator chamber, it will be particularly described with reference to a refrigerator such as that disclosed in the above-mentioned Gelbard patents to which reference is made for detailed description of refrigerator components.

Figure 1:
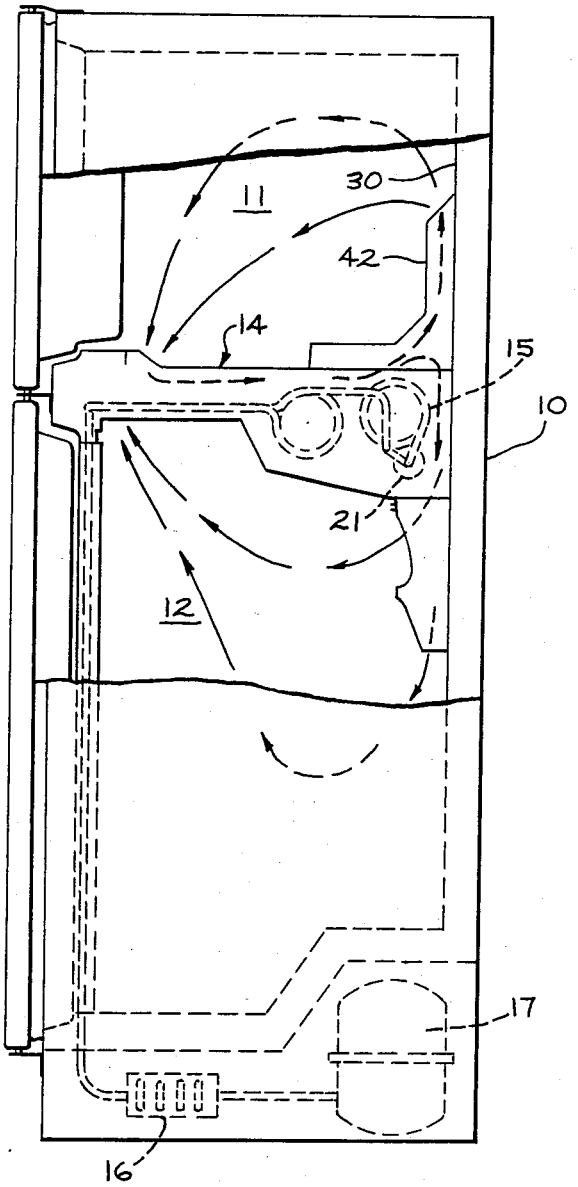
FIG. 1 is a side elevational view of a refrigerator incorporating the present invention.

With reference to FIG. 1, the illustrated refrigerator comprises a cabinet 10 which includes an upper below-freezing or freezer compartment 11 and a lower above-freezing or fresh food storage compartment 12. The compartments 11 and 12 are separated by an insulated partition generally indicated by the numeral 14. The refrigerant system includes an evaporator 15 located in the partition 14, a condenser 16 and compressor 17 interconnected in series flow arrangement. Also as is customary in household refrigerator systems there is provided an accumulator 21 employed traditionally for charge management purposes.

The partition 14 (FIG. 2) includes upper removably arranged wall 18 and a lower wall 19 defining an evaporator chamber 20. It should be noted that the upper wall 18 defines the lower wall of the freezer compartment 11 while the lower wall 19 defines the upper wall of the fresh food compartment 12. Mounted in the partition 14 is a housing 22 which forms the evaporator chamber 20 in which the evaporator 15 is arranged. The housing includes a base wall portion 24 spaced and insulated from the lower wall 19 a top wall portion 26, and a rear wall 28 spaced from the rear wall 30 of the refrigerator cabinet 10. The walls 24 and 26 at the forward portion of the chamber 20 are spaced to include an inlet opening 32.

Figure 2:
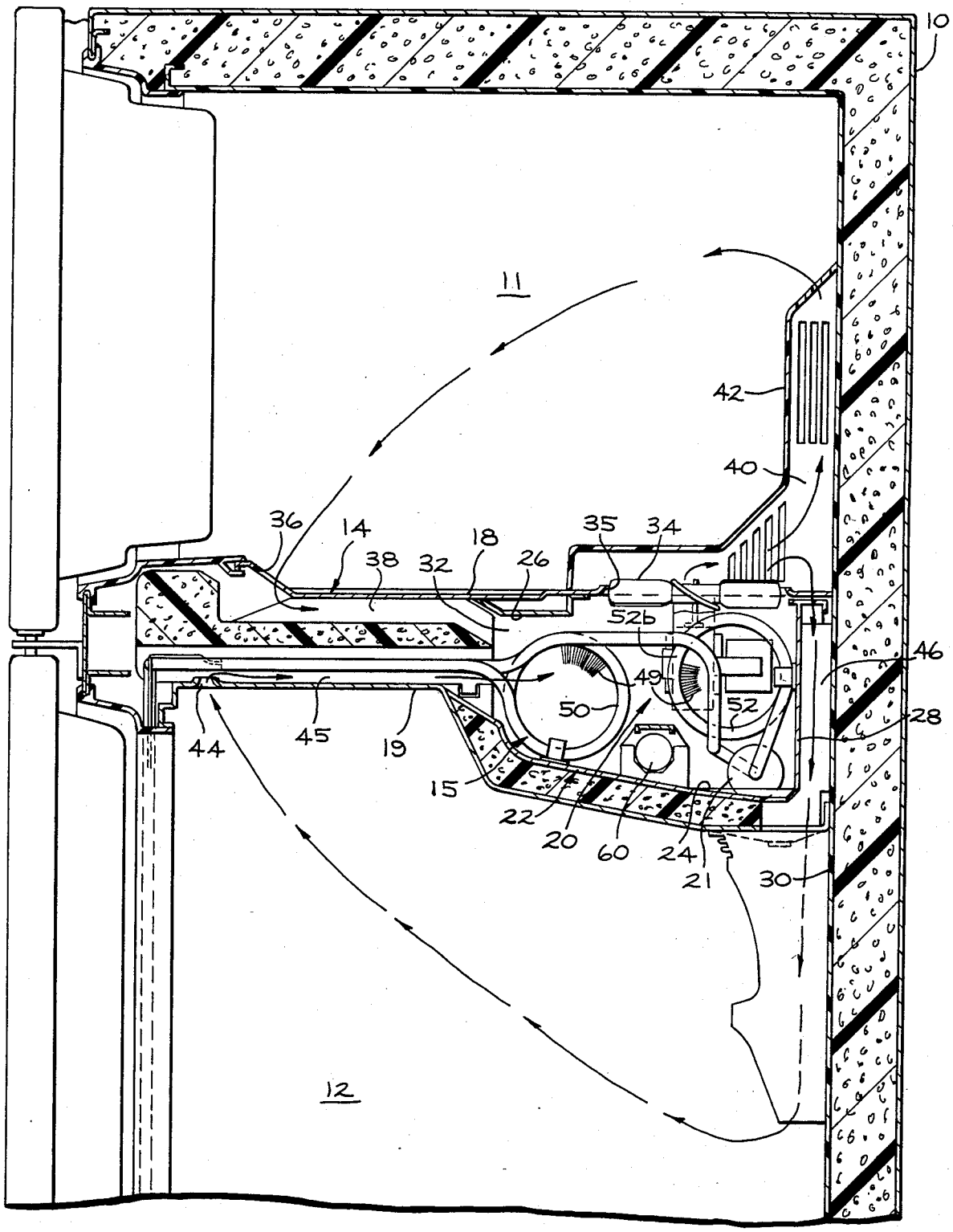
FIG. 2 is an enlarged vertical side elevational view through a portion of the refrigerator showing the partition embodying the present invention.

For the purpose of maintaining these two compartments 11 and 12 at the desired operating temperatures by means of the evaporator 15 contained within the evaporator chamber 20, a fan 34 is provided for withdrawing air from the two storage compartments. The fan 34 is supported on the upper wall 18 with its blade mounted in an opening 35. By this arrangement the fan may be serviced by lifting and removing the wall 18 from the partition assembly. Air from compartment 11 is withdrawn through an inlet 36 in wall 18. The opening 36 is arranged at the forward end of a passage 38 in the partition leading to the opening 32 of evaporator chamber 20. Air cooled by passing through the evaporator 15 is returned to the freezer compartment through opening 35 to a passage 40. The passage 40 is formed by a shroud member 42 which serves to distribute the air from the opening 35 at the outlet end of the evaporator chamber 20. Air from storage compartment 12 is withdrawn through an inlet 44 in lower wall 19. The opening 44 is arranged at the forward end of a passage 45 leading to opening 32 of evaporator chamber 20. Air cooled by passing through the evaporator is returned to the storage compartment 12 through passage 46. The passage as shown in FIG. 2 is defined by wall 28 at the rear of the partition 14 and rear wall 30 of the refrigerator cabinet. While the recirculating air streams of the compartments 11 and 12 were described separately it should be noted that the air from both compartments is mixed as they enter the chamber 20 through inlet 32. In the present embodiment approximately 90% of this mixed cooled air is returned to the freezer compartment 11 with 10% returning to the fresh food compartment 12.

Figure 3:
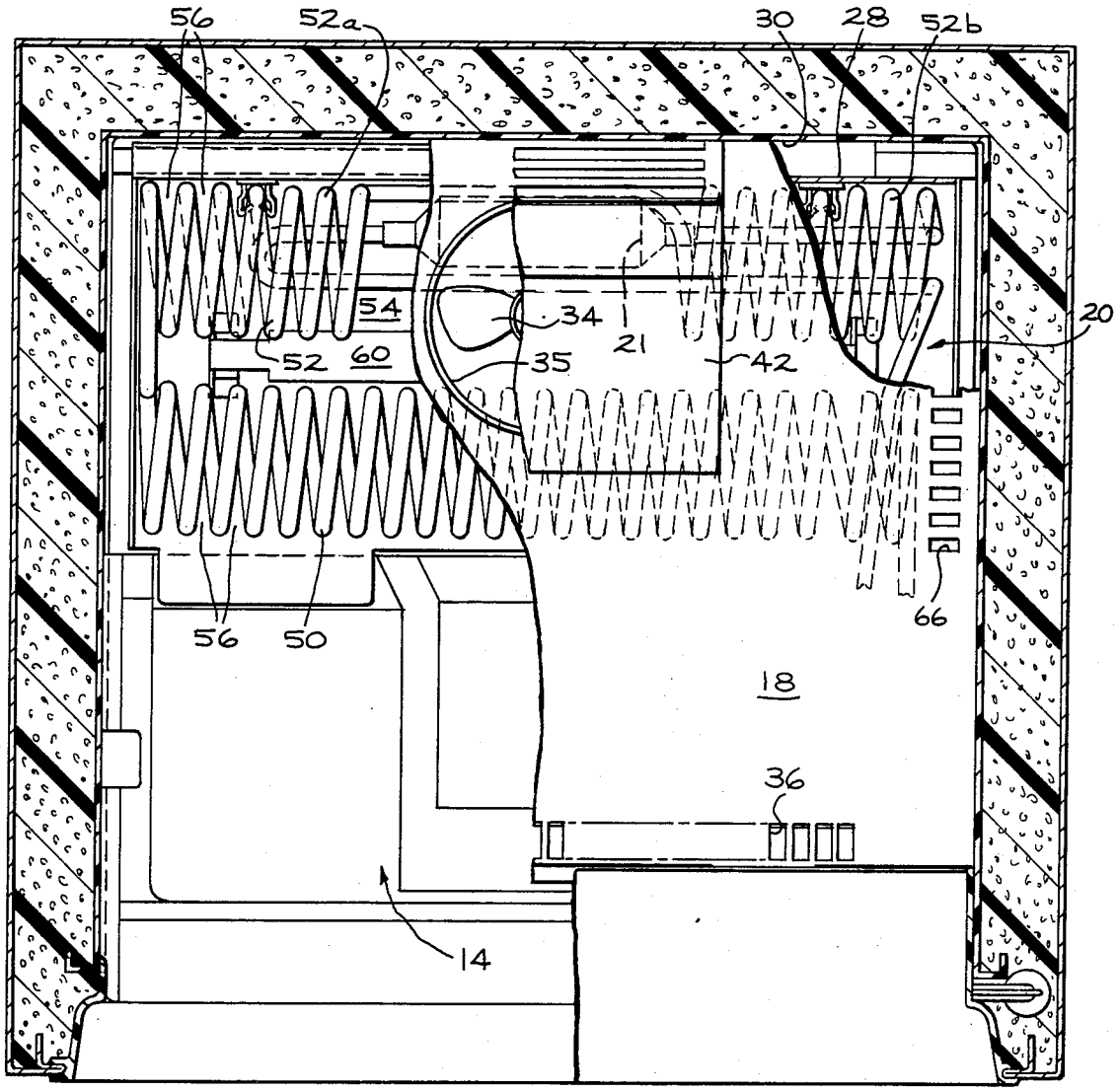
FIG. 3 is a plan view of the partition with parts broken away to show further details.

In the illustrated embodiment of the invention the refrigerator system evaporator 15 actually comprises two helically coiled members 50 and 52. The axis of the coil members extend parallel to one another and transversely of the chamber 20. The coil 52 is arranged to the rear of or downstream of coil 50. The portions 50 and 52 are connected in series through a section of evaporator tubing which is partially straightened and deformed to provide a connection between the two members 50, 52 at one side of the evaporator 15. The rear coil 52, as best shown in FIG. 3, contains two transversely separated end portions **52*a* and 52*b* creating a centrally located space or area 54. The fan 34 which as mentioned above is mounted on the upper wall 18 has its motor positioned partially below the coil 52 between the end portions 52*a* and 52*b* and generally in the area 54. The refrigeration system accumulator 21 is locatd below the coil 52 and generally in the area 54 between the end portions 52*a* and 52*b* of coil 52**.

The extended heat transfer surface for transferring heat from a stream of air passed over the evaporator 15 to the refrigerant flowing through the tubular evaporator 15 comprises a plurality of pin fins 49 (FIG. 2) extending generally radially inwardly from the coils 50, 52 so that all of the fin structure is within the area or volume encompassed by the coils 50, 52.

In order to maintain the refrigerator at a desirable level of operating efficienty, it is necessary from time to time to initiate a defrost operation to remove the frost from the evaporator surfaces. This may be accomplished in a number of ways, for example, by providing an electric heating element which is energized at intervals to melt the frost. A suitable electric heating element 60 for this purpose is shown (FIGS. 2 and 3) extending transversely of the chamber 20. The heater 60 is positioned adjacent the lower wall 24 of chamber 20 at a location between the lower portion coils 50 and 52. This position of the heater as shown in FIG. 2 exposes a substantial area of both coils 50, 52 to the radiant energy of the heater during the defrost operation.

It should be noted that the accumulator 21 due to its arrangement in the suction line is generally the coldest component in the system and accordingly frost tends to build up on it in heavier concentrates relative to the warmer components. The accumulator 21 because of its position relative to the heater as shown in FIG. 2 is exposed to the radiant energy of the heater during the defrost operation.

With reference to FIGS. 2 and 3 of the drawing, it will be seen that air drawn into the front or inlet end 32 of the evaporator chamber 20 by operation of the fan 34 flows laterally or transversely between the evaporator coils, that is, through passages 56 (FIG. 2) between the coil passages or portions 50, 52. Since the pin fins 49 are all contained within the helix, the air initially contacts the tubular member where moisture begins to collect in the form of frost. The air passing through the passages 56 then comes into heat exchange contact with the internal fin structure extending part way into each of these passages from the adjacent coil and then more or less directly impinges on the fins extending radially inwardly or forwardly from the rear portion of the coil.

By the present invention means are provided for increasing the frost tolerance of the evaporator by insuring that frost build-up is evenly distributed on the evaporator surfaces. In order to accomplish this objective the evaporator 15 of the illustrated embodiment has been configured so that substantially all of the air flowing through the chamber 20 contacts both of the coil members 50 and 52. In this end as shown in FIG. 2, the coil 52 is raised relative to coil 50 so that a portion of coil 52 is effectively located in the path of air flowing through inlet 32 of chamber 20. Since the front coil 50 contains more surface, it in fact does the primary cooling and the sensible heat is also first removed by coil 50 with the remaining sensible heat removed by coil 52. The raised position of the rear coil 52 by its placement in the air stream creates an evaporator having a greater frost tolerance. By exposing a greater portion of the total evaporator surface to the circulating air stream a more equal distribution of frost is achieved. By the present configuration in the event frost does initially build up on the front coil 50 thereby decreasing air flow therethrough a greater amount of air will then flow past it and eventually most of the air will then flow through on the rear coil 52. This allows for the even distribution of frost and lessening the chances of frost build-up from blocking air flow through the evaporator. To enhance the distribution of air across the surface area of the evaporator additional inlets 66 (FIG. 3) communicating directly into the chamber 20 may be provided adjacent the side walls of the refrigerator cabinet so that a portion of the air returning from compartment 11 is directed inwardly.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. In a refrigerator cabinet including a fresh food storage compartment to be maintained at a temperature above freezing and a freezer compartment to be maintained at a temperature below freezing, an air circulating and evaporator arrangement comprising:

a partition dividing said compartments including a first wall portion defining the upper wall of said fresh food compartment including an inlet opening, and a second wall portion defining the lower wall of said freezer compartment including an air inlet and an air outlet;

air passageways in said partition for directing air through said compartments communicating between said inlet in said first and second wall portions and said outlet in said second wall portion;

fan means mounted on said second wall portion arranged in said partition for circulating air from said inlets in said first and second wall portions through said evaporator chamber to said outlet in said second wall portion;

an evaporator including a tubular member bent to form at least two interconnected helically coiled portions extending transversely in said evaporator chamber, the longitudinal axis of said coils being substantially parallel to each other and perpendicular to said air circulating from said inlets to said outlets, the axis of one of said coils being elevated relative to the axis of the other coil so that air entering said evaporator chamber from said inlets will impinge on both of said coiled portions of said evaporator to thereby increase the frost tolerance of said evaporator.

2. The refrigerator cabinet of claim 1 further including an evaporator chamber in said partition interposed between said inlets in said wall portions and said outlet in said second wall portion including an inlet communicating with said inlets in said wall portions and an outlet aligned with said outlet in said second wall portion.

* * * * *